US005996303A

United States Patent [19]

Pellock

[11] Patent Number: 5,996,303

[45] Date of Patent: Dec. 7, 1999

[54] TRUSS WITH ALTERNATING METAL WEB

[75] Inventor: Michael A. Pellock, Edwardsville, Ill.

[73] Assignee: MiTek Holdings, Inc., Wilmington, Del.

[21] Appl. No.: 09/252,693

[22] Filed: Feb. 18, 1999

[51] Int. Cl.[6] ..... E04C 3/292

[52] U.S. Cl. ..... 52/693; 52/694; 52/696; 52/737.3

[58] Field of Search ..... 52/693, 694, 696, 52/737.3

[56] References Cited

U.S. PATENT DOCUMENTS

| | | | |
|---|---|---|---|
| 4,031,686 | 6/1977 | Sanford | 52/693 |
| 4,308,703 | 1/1982 | Knowles . | |
| 4,442,649 | 4/1984 | Birckhead | 52/693 |
| 5,592,800 | 1/1997 | Koo et al. | 52/693 X |

FOREIGN PATENT DOCUMENTS

| | | |
|---|---|---|
| 689190 | 9/1995 | Australia . |

OTHER PUBLICATIONS

MiTek Posi–Strut Metal Web Truss System, 6 pgs., 1996.

*Primary Examiner*—Christopher T. Kent
*Attorney, Agent, or Firm*—Armstrong Teasdale LLP

[57] ABSTRACT

A truss that, in one embodiment, includes alternating metal webs in non-critical portions of the truss is described. The truss includes two chords vertically spaced apart and parallel to each other, and a plurality of metal web members extending between the two chords and coupled to the vertical surfaces of the chords. The truss also includes at least two critical portions and at least one non-critical portion. The critical portions of the truss are configured so that the metal webs coupled to each side of the truss are aligned, and each metal web coupled to one side of the truss has a corresponding metal web coupled to the other side of the truss. The non-critical portions of the truss are configured so that the metal webs coupled to one side of the truss do not have a corresponding aligned metal web coupled to the opposite side of the truss. Rather, the metal webs are coupled to the chords in an alternating pattern where there is a metal web coupled to one side of the truss, then a space, then another metal web, and so on. The other side of the truss has a similar configuration, only offset, so that the spaces on each side of the truss align with a metal web on the opposite side of the truss.

16 Claims, 3 Drawing Sheets

TRUSS WITH ALTERNATING METAL WEB

FIELD OF THE INVENTION

This invention relates generally to trusses and more particularly, to wooden trusses having metal webs.

BACKGROUND OF THE INVENTION

Pre-manufactured wooden trusses greatly facilitate the construction of buildings and other structures. Known trusses are essentially planar structures with spans and heights far exceeding their thickness. One type of truss is the parallel chord type truss. Parallel chord trusses generally include a bottom chord, a top chord vertically spaced and parallel to the bottom chord, and webs extending between the top and bottom chords. The webs may be fabricated from wood and are typically coupled to the top and bottom chords by nailing plates having integrally formed teeth that are configured to be embedded into the surface of the chords and the webs. Alternatively, a parallel chord truss may include metal webs. The metal webs may be U-shaped, V-shaped, W-shaped, or S-shaped and are configured to attach to the vertical surface of the chords, typically with integrally formed teeth protruding from the web. Metal webs are attached to both sides of the truss along the entire length of the truss to provide strength and stability to the truss. A metal web attached to one side of the truss has a corresponding metal web attached to the other side of the truss that is in alignment with the first metal web. A truss with aligned metal webs on opposing sides of the truss provides openings or passage ways through the truss for electrical wires and plumbing pipes.

Parallel chord trusses may be used for floor joists and roof rafters in place of solid lumber 2×8, 2×10, or 2×12 joists. Trusses typically are stronger than solid lumber and permit greater spans and greater spacing between joists. The open web configuration of trusses eliminates the need for drilling passage holes for electrical and plumbing services. However, there is a need for being able to pass more, and/or larger items through the trusses, for example, heating and cooling ducts.

It would be desirable to provide trusses having more and/or larger openings to permit passing more services, such as plumbing pipes and heating and cooling ducts through the trusses while maintaining truss strength.

SUMMARY OF THE INVENTION

These and other objects may be attained by a truss that, in one embodiment, includes alternating metal webs in non-critical portions of the truss. The truss includes two chords vertically spaced apart and parallel to each other, and a plurality of metal web members extending between the two chords and coupled to the vertical surfaces of the chords. The truss also includes at least two critical portions and at least one non-critical portion.

The critical portions of the truss are configured so that the metal webs coupled to each side of the truss are aligned, and each metal web coupled to one side of the truss has a corresponding metal web coupled to the other side of the truss. The non-critical portions of the truss are configured so that the metal webs coupled to one side of the truss do not have a corresponding aligned metal web coupled to the opposite side of the truss. Rather, the metal webs are coupled to the chords in an alternating pattern where there is a metal web coupled to one side of the truss, then a space, then another metal web, and so on. The other side of the truss has a similar configuration, only offset, so that the spaces on each side of the truss align with a metal web on the opposite side of the truss.

The metal webs include a flat central connecting portion with a strut extending from each end of the connecting portion and configured so that the metal web is substantially V-shaped. A flat engagement portion extends from the end of each strut. The central connecting portion and the engagement portions of each strut include integrally formed teeth, protruding therefrom, configured to penetrate the side surface of the chords of the truss to couple the metal web to the truss.

The truss is fabricated by positioning two wooden chords parallel to each other and spaced apart a predetermined distance. Typically, each end of the truss includes a wooden block extending between the chords. Nail plates having integrally formed teeth are positioned at the interfaces between the blocks and the upper and lower chords so that the nail plates overlie the sides of the blocks and the chords. A pressing force is exerted on the nail plates so that the integrally formed teeth become embedded into the wooden block and the chords.

Metal webs are positioned on each side of the truss with the central connecting portion of each web overlying a side of the lower chord and the engagement portions of the struts overlying a side of the upper chord. In the critical portions of the truss, the metal webs are positioned so that, for each metal web on one side of the truss there is an aligned corresponding metal web on the other side of the truss. In the non-critical portions of the truss, the metal webs are positioned in an alternating configuration. On one side of the truss, the webs are arranged web, then space, then web, and so on. On the other side of the truss the webs are arranged space, then web, then space, and so on, so that a web on one side aligns with a space on the other side. Typically, the longitudinal length of the space is equal to the longitudinal length of the web so that the alternating webs do not overlap. A force is then exerted on the truss to embed the integral nails of the central connecting portions and the engagement portions of the metal webs into the lower and upper chords respectively.

The alternating metal web configuration of the above described truss provides for larger openings in the non-critical portions of the truss. The larger openings permit more services such as plumbing pipes and heating and cooling ducts to pass through the truss. The alternating web configuration in the non-critical portion of the truss does not affect the overall strength of the truss. The load carrying capacity and resistance to rotational twisting of the above described truss is equivalent to a truss that is configured with aligned corresponding webs coupled to both sides of the truss along the complete length of the truss.

DETAILED DESCRIPTION

Figure 1:
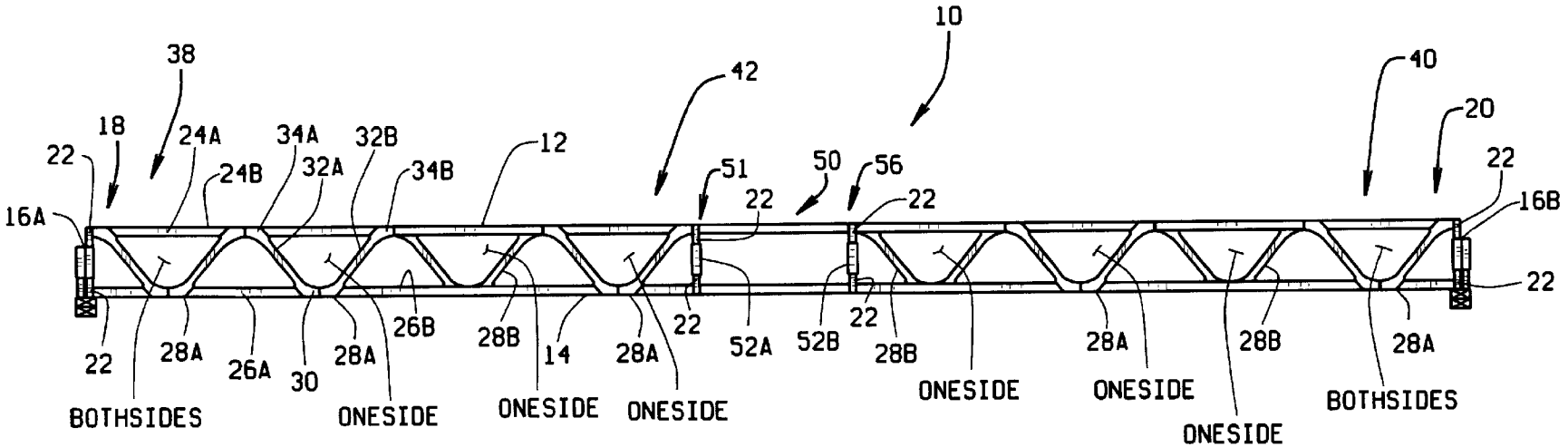
FIG. 1 is a side view of a truss in accordance with one embodiment of the present invention.
Figure 2:
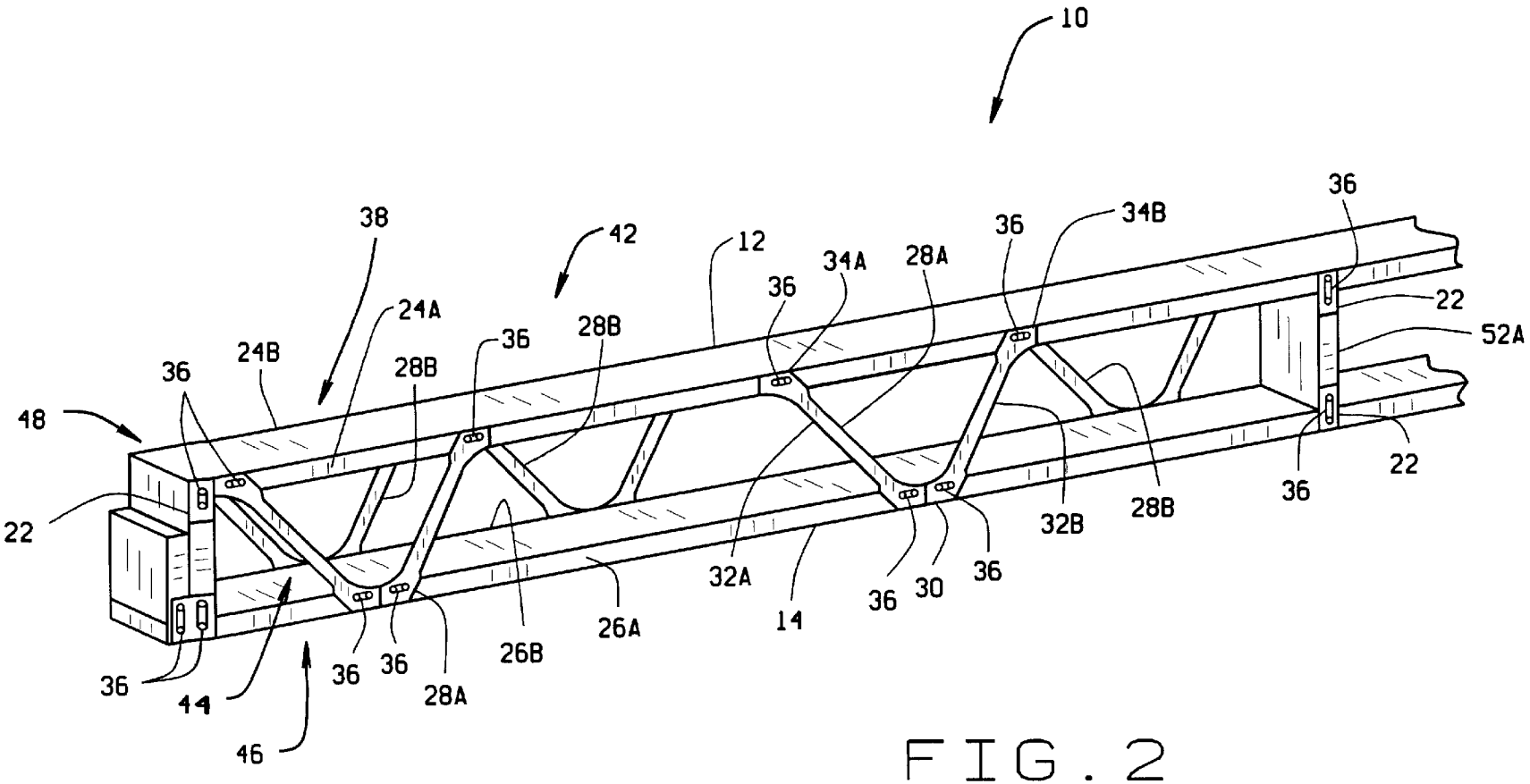
FIG. 2 is a perspective view of a section of the truss shown in FIG. 1.

FIG. 1 is a side view of a truss 10 in accordance with one embodiment of the present invention. FIG. 2 is a perspective view of a section of truss 10. Referring to FIGS. 1 and 2, truss 10 includes an upper chord 12 and a lower chord 14 configured to be parallel to each other. Wood blocks 16A and 16B extend between upper chord 12 and lower chord 14 at ends 18 and 20 respectively. Nail plates 22 secure wood blocks 16A and 16B to upper and lower chords 12 and 14.

Upper and lower chords 12 and 14 include first side surfaces 24A and 26A, and second side surfaces 24B and 26B respectively. When truss 10 is in operational position, side surfaces 24A, 24B, 26A, and 26B are vertically positioned.

Truss 10 also includes a plurality of metal web members 28A and 28B extending between and coupled to upper and lower chords 12 and 14. Particularly, metal webs 28A are coupled to first side surfaces 24A and 26A of upper and lower chords 12 and 14 respectively along the length of truss 10. Metal webs 28B are coupled to second side surfaces 24B and 26B of upper and lower chords 12 and 14 respectively along the length of truss 10.

Each metal web 28A and 28B includes a flat central connecting portion 30. Struts 32A and 32B extend from each end of connecting portion 30 and are configured so that metal webs 28A and 28B are substantially V-shaped. Flat engagement portions 34A and 34B extend from struts 32A and 32B respectively. Connecting portion 30 and engagement portions 34A and 34B are configured to couple to side surfaces 24A, 24B, 26A and 26B. Particularly, central connecting portion 30 and engagement portions 34A and 34B include integrally formed teeth 36 extending from webs 28A and 28B. Teeth 36 are configured to penetrate side surfaces 24A, 24B, 26A and 26B of upper and lower chords 12 and 14. In one embodiment, connecting portion 30 is configured to couple to side surface 26A or 26B of lower chord 14, and engagement portions 34A and 34B are configured to couple to side surfaces 24A or 24B of upper chord 12. Also nail plates 22 include integrally formed teeth 36 configured to penetrate upper and lower chords 12 and 14, and blocks 16A and 16B.

Truss 10 further includes critical portions 38 and 40 located at ends 18 and 20 respectively, and a non-critical portion 42 located between critical portions 38 and 40. Critical portions 38 and 40 of truss 10 are configured so that metal webs 28A and 28B are aligned, and each metal web 28A coupled to first side surfaces 24A and 26A has a corresponding metal web 28B coupled to second side surfaces 24B and 26B. Aligned metal webs 28A and 28B form an aligned web pair 44. Each aligned web pair 44 has an associated load bearing capacity. The load bearing capacity of web pair 44 is dependent on the physical characteristics of metal webs 28A and 28B, such as, web profile, metal thickness, and the like.

Non-critical portion 42 of truss 10 is configured so that each metal web 28A does not have a corresponding aligned metal web 28B. Particularly, metal webs 28A and 28B are coupled to upper and lower chords 12 and 14 in an alternating arrangement where metal web 28A is coupled to first sides 24A and 26A, then a space, then another metal web 28A, and so on. Metal webs 28B are coupled to second sides 24B and 26B in a similar configuration, only offset, so that the spaces on first side 46 of truss 10 align with a metal web 28B coupled to a second side 48 of truss 10. Also the spaces on second side 48 of truss 10 align with a metal web 28A coupled to first side 46 of truss 10. The spaces are the same length as metal webs 28A and 28B so there is no overlap of web member 28A on first side 46 of truss 10 with web member 28B on second side 48 of truss 10.

A non-critical portion of truss 10 may be defined as a portion of truss 10 where the shear load on truss 10 is less than one half the shear capacity of a web pair 44. A critical portion of truss 10 may be defined as a portion of truss 10 where the shear load is greater than one half the shear capacity of a web pair 44.

Truss 10 further includes a chase section 50 located in non-critical portion 42. Particularly, chase 50 is a section of non-critical portion 42 that does not contain any metal web members 28A or 28B. Chase 50 is an opening extending through truss 10. Chase 50 permits services such as electrical lines, plumbing pipes, telephone cables, computer cables, and heating and cooling ducts to pass through truss 10 unimpeded.

Blocks 52A and 52B extend between upper and lower chords 12 and 14 at ends 54 and 56 of chase section 50. Nail plates 22 couple blocks 52A and 52B to upper and lower chords 12 and 14. In an alternate embodiment, chase 50 does not include blocks positioned at ends 54 and 56.

Truss 10 is fabricated by positioning wooden chords 12 and 14 parallel to each other and spaced apart a predetermined distance. Wooden blocks 16A and 16B are positioned at ends 18 and 20 of truss 10, and blocks 52A and 52B are positioned at ends 54 and 56 of chase 50 in non-critical portion 42, each block extending between chords 12 and 14. Nail plates 22 are positioned at the interfaces between blocks 16A, 16B, 52A, and 52B and upper and lower chords 12 and 14 so that nail plates 22 overlie blocks 16A, 16B, 52A and 52B and chords 12 and 14. A pressing force is exerted on nail plates 22 so that integrally formed teeth 36 become embedded into blocks 16A, 16B, 52A, and 52B and chords 12 and 14.

Metal webs 28A and 28B are positioned on sides 46 and 48 of truss 10 with central connecting portion 30 of each web 28A and 28B overlying sides 26A and 26B of lower chord 14 and engagement portions 34A and 34B overlying a side 24A and 24B of upper chord 12. In critical portions 38 and 40 of truss 10, metal webs 28A and 28B are positioned so that each metal web 28A coupled to first side surfaces 24A and 26A has a corresponding metal web 28B coupled to second side surfaces 24B and 26B. In non-critical portion 42 of truss 10, metal webs 28A and 28B are positioned in an alternating configuration as described above with no overlap of webs 28A and 28B. A force is then exerted on truss 10 to embed integral nails 36 of central connecting portions 30 and the engagement portions 34A and 34B of metal webs 28A and 28B into lower and upper chords 14 and 12 respectively.

The alternating metal web configuration of above described truss 10 provides for larger openings in non-critical portions 42 of truss 10. The larger openings permit more services such as plumbing pipes and heating and cooling ducts to pass through truss 10. The alternating web configuration in non-critical portion 42 of truss 10 does not affect the overall strength of truss 10. The total load carrying capacity and resistance to rotational twisting of above described truss 10 is equivalent to a truss that is configured with aligned corresponding webs coupled to both sides of the truss along the complete length of the truss.

Figure 3:
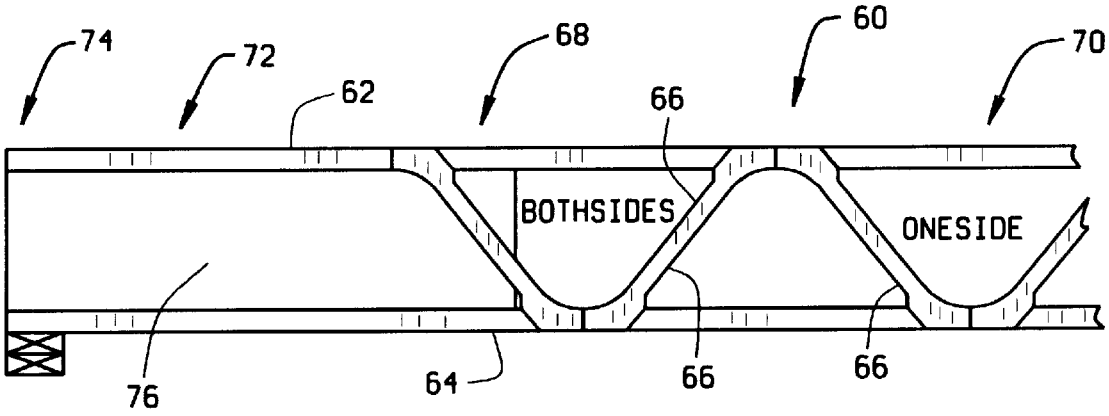
FIG. 3 is a side view of a section of a truss in accordance with another embodiment of the present invention.
Figure 4:
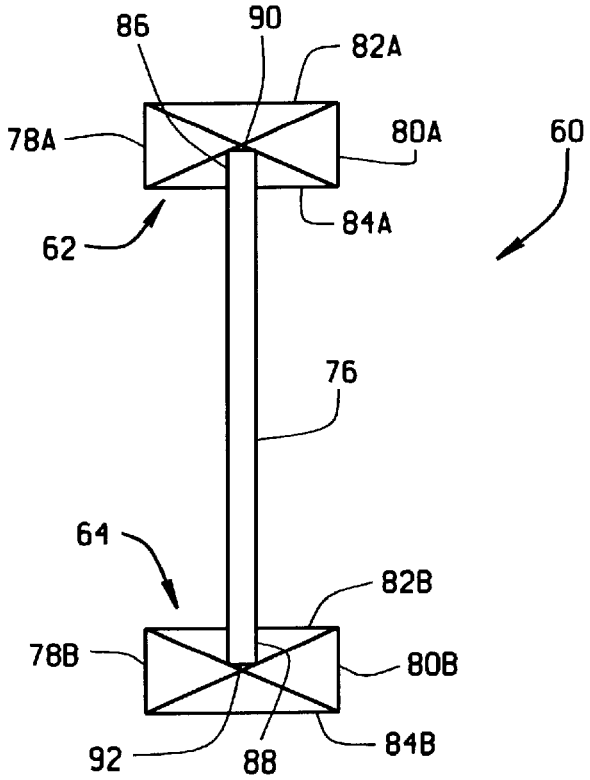
FIG. 4 is a front view of the truss section shown in FIG. 3.

FIG. 3 is a side view, and FIG. 4 is a front view of a section of a truss 60 in accordance with another embodiment of the present invention. Truss 60 includes an upper chord 62 and a lower chord 64 configured to be parallel to each other, and a plurality of metal web members 66 extending between and coupled to upper and lower chords 62 and 64. Truss 60 also includes critical portion 68 and non-critical portion 70.

Metal web members 66 are positioned in critical and non-critical portions 68 and 70 of truss 60 identical to the web members in truss 10 described above.

Critical portion 68 includes a trimmable section 72 at end 74 of truss 60. Trimmable section 72 permits truss 60 to be trimmed or cut to adjust the length of truss 60 to overcome any space discrepancies in the structure truss 60 is to be installed in. To permit truss 60 to be trimmed, there are no metal web members 60 located in trimmable section 72.

Particularly, trimmable section 72 includes a wooden member 76 extending longitudinally along truss 60 from end 74 to a first metal web member 66. Wooden member 76 extends between and is coupled to upper and lower chords 62 and 64.

Upper and lower chords 62 and 64 include a first side 78A and 78B, a second side 80A and 80B, an upper side 82A and 82B, and a lower side 84A and 84B respectively. A groove 86 extends longitudinally in lower side 84A of upper chord 62 and a groove 88 extends longitudinally in upper side 82B of lower chord 64. Groove 86 is located between first and second sides 78A and 80A of upper chord 6 2, and groove 88 is located between first and second sides 78 B and 80 B of lower chord 64. Grooves 86 and 88 are configured to receive an upper side 90 and a lower side 92 of wooden member 76 respectively. Wooden member 76 is coupled to upper and lower chords 62 and 64 by a pressed fit of upper and lower sides 90 and 92 in grooves 86 and 88 respectively.

In other embodiments, truss 60 may include a trimmable section 72 located at both ends. Additionally, trusses 10 and 60 may have multiple non-critical portions separated by critical portions. However, in these alternative embodiments, trusses 10 and 60 include a critical portion located at each end.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

I claim:

1. A truss comprising:

an elongate first chord and an elongate second chord spaced vertically apart and parallel to each other, each said first and said second chord comprising a first vertical face and a second vertical face;

a plurality of metal web members extending between and coupled to said first and second chords, said web members located along said vertical faces of said upper and lower chords;

at least two critical portions and at least one non-critical portion, said critical portions comprising web members located on each vertical face of said first and second chords and configured so that each said web member coupled to said first vertical faces is aligned with a corresponding web member coupled to said second vertical faces forming an aligned web member pair, said non-critical portion comprising web members located on each vertical face of said first and second chords and configured so that said web members coupled to said first vertical faces do not align with said web members coupled to said second vertical faces forming an alternating web arrangement, said alternating web arrangement configured so that there is no overlap of web members coupled to said first vertical faces and said web members coupled to said second vertical faces.

2. A truss in accordance with claim 1 wherein said metal web members are substantially V-shaped and each comprise a first strut portion, a second strut portion, and a central connector portion, said first and second strut portions extending from opposite ends of said central connecting portion, said central portion configured to couple to said first chord of said truss and said strut portions configured to couple to said second chord of said truss.

3. A truss in accordance with claim 2 wherein said central portion of said metal webs comprise a plurality of integrally formed teeth configured to penetrate said vertical surface of said first chord.

4. A truss in accordance with claim 3 wherein said first and said second strut portions each comprise an engagement portion extending from an end, said engagement portion comprising integrally formed teeth configured to penetrate said vertical surface of said second chord.

5. A truss in accordance with claim 1 wherein said non critical portion comprises at least one chase section, said chase section being free of said metal webs.

6. A truss in accordance with claim 1 wherein a first critical portion is located at a first end of said truss and a second critical portion is located at a second end of said truss.

7. A truss in accordance with claim 6 wherein said first critical portion comprises a trimable section, said trimable section comprising a board coupled to said first chord at a position between said first and second vertical faces and to said second chord at a position between said first and second vertical faces, said board extending from said first end of said truss to a first web member pair, said trimable section having an I-shaped cross-section and being free of said metal web members.

8. A truss in accordance with claim 7 wherein said second critical portion comprises a trimable section, said trimable section comprising a board coupled to said first chord at a position between said first and second vertical faces and to said second chord at a position between said first and second vertical faces, said board extending from said second end of said truss to a web member pair, said trimable section having an I-shaped cross-section and being free of said metal web members.

9. A structure comprising a plurality of trusses, each said truss comprising:

an elongate first chord and an elongate second chord spaced vertically apart and parallel to each other, each said first and said second chord comprising a first vertical face and a second vertical face;

a plurality of metal web members extending between and coupled to said first and second chords, said web members located along said vertical faces of said upper and lower chords;

at least two critical portions and at least one non-critical portion, said critical portions comprising web members located on each vertical face of said first and second chords and configured so that each said web member coupled to said first vertical faces is aligned with a corresponding web member coupled to said second vertical faces forming an aligned web member pair, said non-critical portion comprising web members located on each vertical face of said first and second chords and configured so that said web members coupled to said first vertical faces do not align with said web members coupled to said second vertical faces forming an alternating web arrangement, said alternating web arrangement configured so that there is no overlap of web members coupled to said first vertical faces and said web members coupled to said second vertical faces.

10. A structure in accordance with claim 9 wherein said metal web members are substantially V-shaped and each comprise a first strut portion, a second strut portion, and a central connector portion, said first and second strut portions extending from opposite ends of said central connecting portion, said central portion configured to couple to said first chord of said truss and said strut portions configured to couple to said second chord of said truss.

11. A structure in accordance with claim 10 wherein said central portion of said metal webs comprise a plurality of integrally formed teeth configured to penetrate said vertical surface of said first chord.

12. A structure in accordance with claim 11 wherein said first and said second strut portions each comprise an engagement portion extending from an end, said engagement portion comprising integrally formed teeth configured to penetrate said vertical surface of said second chord.

13. A structure in accordance with claim 9 wherein said non critical portion comprises at least one chase section, said chase section being free of said metal webs.

14. A structure in accordance with claim 9 wherein a first critical portion is located at a first end of said truss and a second critical portion is located at a second end of said truss.

15. A structure in accordance with claim 14 wherein said first critical portion comprises a trimable section, said trimable section comprising a board coupled to said first chord at a position between said first and second vertical faces and to said second chord at a position between said first and second vertical faces, said board extending from said first end of said truss to a first web member pair, said trimable section having an I-shaped cross-section and being free of said metal web members.

16. A structure in accordance with claim 15 wherein said second critical portion comprises a trimable section, said trimable section comprising a board coupled to said first chord at a position between said first and second vertical faces and to said second chord at a position between said first and second vertical faces, said board extending from said second end of said truss to a web member pair, said trimable section having an I-shaped cross-section and being free of said metal web members.

* * * * *